US006928758B1

(12) United States Patent
Stout

(10) Patent No.: US 6,928,758 B1
(45) Date of Patent: Aug. 16, 2005

(54) TRENCHING TOOL

(76) Inventor: Kenneth L. Stout, 7512 Mesquite Wood NW., Albuquerque, NM (US) 87120

( * ) Notice: Subject to any disclaimer, the term of this patent is extended or adjusted under 35 U.S.C. 154(b) by 0 days.

(21) Appl. No.: 10/935,401

(22) Filed: Sep. 7, 2004

(51) Int. Cl.[7] ..... E02F 3/96
(52) U.S. Cl. ..... 37/403; 37/444; 37/903
(58) Field of Search ..... 37/403, 466, 404–409, 37/444, 379, 903; 414/720, 723, 724, 685, 414/912; 172/810

(56) References Cited

U.S. PATENT DOCUMENTS 3,305,952 A * 2/1967 Dressler ..... 37/444
4,068,771 A * 1/1978 Zimmerman ..... 414/420
5,273,375 A 12/1993 Plourde
5,833,008 A 11/1998 Reed et al.
5,901,479 A * 5/1999 Langdon ..... 37/444
5,909,961 A * 6/1999 Pullman ..... 37/444
6,067,733 A 5/2000 Gasper
6,085,447 A 7/2000 Rose
6,701,630 B2 3/2004 Humphrey

* cited by examiner

*Primary Examiner*—Robert E Pezzuto
(74) *Attorney, Agent, or Firm*—Kenneth E. Callahan

(57) ABSTRACT

A trenching tool attachable to the bucket of a front-end loader that is pushed through the soil parallel to the surface having an inclined plate to guide the soil into the bucket.

7 Claims, 2 Drawing Sheets

FIG. 1A
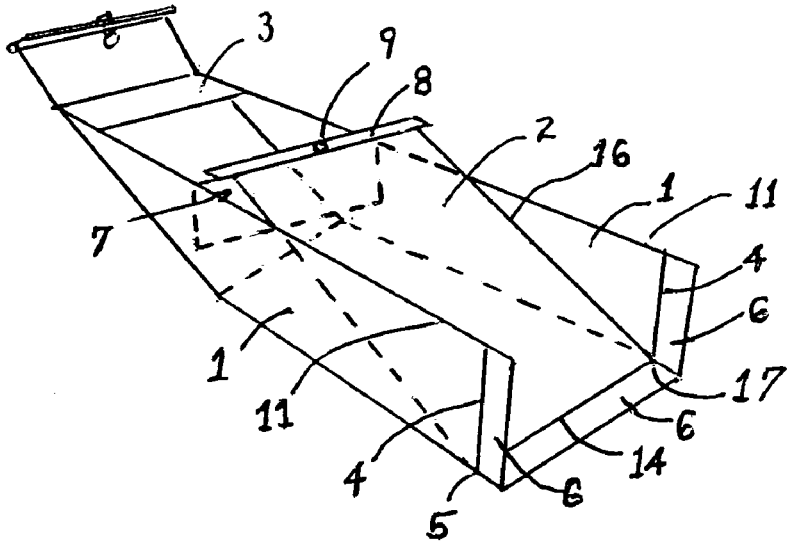
FIG. 1B
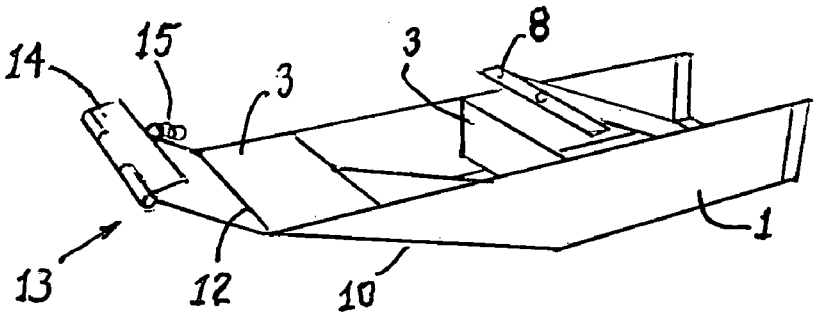
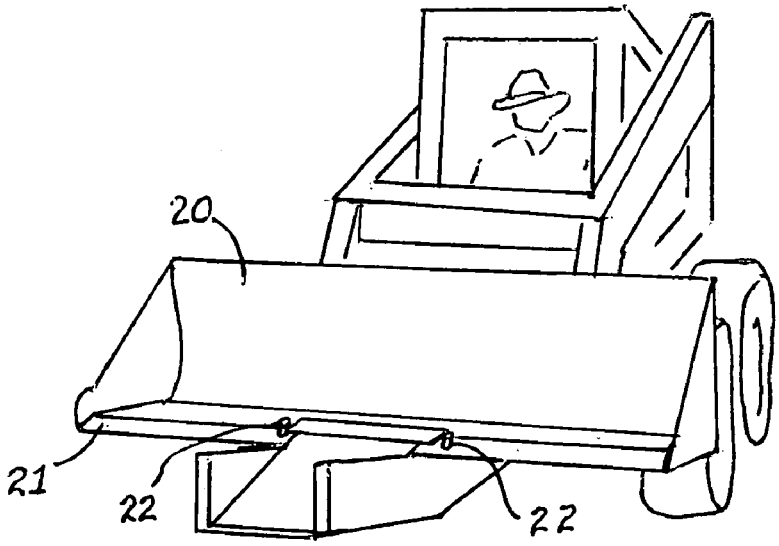
FIG. 2

TRENCHING TOOL

BACKGROUND OF THE INVENTION

The invention relates generally to an earth-trenching tool and in particular to a trenching tool attachable to the bucket of earth moving equipment, such as a front-end loader or a skid-steer loader.

Trenches are used in the construction industry for many purposes, e.g., providing the foundation for the construction of walls, laying pipes, and providing drainage. Building codes require foundation trenches to be a specific width and depth depending on the soil type and frost line depth. Typically earth is evacuated from a building site to form a level pad at or below the frost line using a front-end loader. A trench is then dug below the pad level to be filled with reinforced concrete to provide a foundation for load-bearing walls. It is important that this foundation trench be dug more or less exactly to the specified dimensions, for example, 16 inches wide and 8 inches deep. Too small and it doesn't meet the specifications, too large and material is unnecessarily wasted. When excavated just to the specification, the contractor can accurately estimate the required concrete for the fill. This type of trench is currently dug using a backhoe and the dirt is piled up along side of the trench and must be subsequently removed. Even with a skilled operator, the trench only approximately matches the desired dimensions so laborers with shovels are required to trim it up.

Consequently, there is a need for a trenching tool that can readily dig an accurately dimensioned trench while disposing of the dirt in a single operation. In addition, it is desirable to have an inexpensive, simple to manufacture tool that is readily attached to equipment already on site, such as a front-end loader or skid-steer loader.

SUMMARY OF THE INVENTION

In a preferred embodiment, the invention provides a trenching tool that is quickly and easily attached to the bucket of earthmoving equipment, such as a front-end loader. The tool has a pair of opposing sidewalls attached to an inclined plate that ramps up from the bottom of the forward edge of the sides to slightly above the height of the sides. This extension of the inclined plate to above the top of the sides forms a notch into which the blade of the bucket is inserted. The front edge of both the sides and the inclined plate may have cutting blades attached. The height of the sides and the width of the inclined plate determine the dimensions of the trench. The sides extend backwards to the back end of the bucket where they are attached. In operation, the bottom of the bucket travels along the surface of the ground pushing the trenching tool forward along the desired path. The trenching tool cuts through the soil while forcing the displaced soil into the bucket via the inclined plate. The result is an accurately dimensioned trench with the excavated dirt in the bucket. The front-end loader can then deposit the dirt at a desired location without removing the trenching tool.

Other aspects and advantages of the present invention will become apparent from the following detailed description, taken in conjunction with the accompanying drawing, illustrating by way of example the principles of the invention.

BRIEF DESCRIPTION OF THE DRAWINGS

FIG. 1A is a perspective view of the trenching tool seen from a front/side view.

FIG. 1B is a perspective view of the trenching tool seen from a rear/side view.

FIG. 2 shows the trenching tool attached to the bucket.

DESCRIPTION OF THE PREFERRED EMBODIMENT

Figure 3:
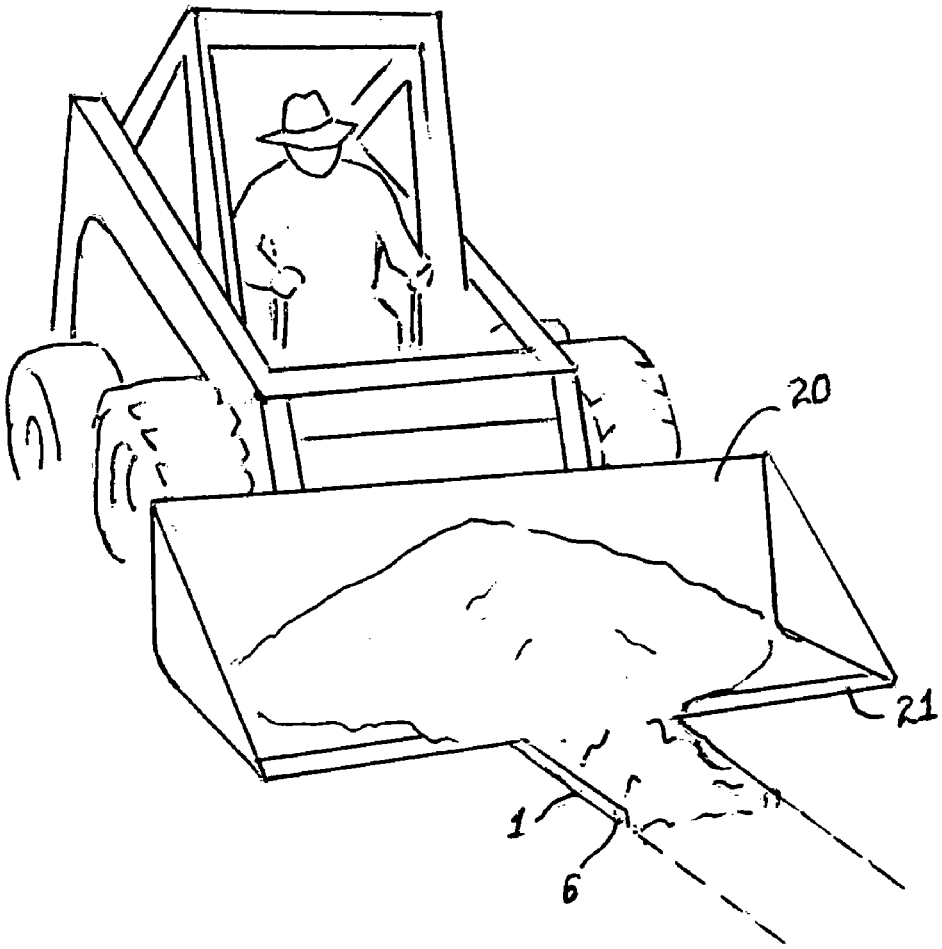
FIG. 3 shows the trenching tool in operation.

Two views of the trenching tool are shown in FIGS. 1A and 1B. The trenching tool assembly is comprised of a pair of sidewall plates 1 maintained in a vertical disposition by an attached inclined plate 2 and other supporting means 3. The side edges 16 of the inclined plate 2 are attached to the sides of the sidewall plates 1 such that the corners of the leading bottom edge 17 of the inclined plate 2 are attached at the forward (leading) edge 4 of the sidewall plates at their lowest point 5 and from there the inclined plate 2 ramps up to a height slightly above the top edge 11 of the sidewall plates 1. This extension of the inclined plate 2 above the top edge of the sidewall plates 11 forms a notch 7 for the insertion of the cutting blade 21 of a front-end loader's bucket 20 (see FIG. 2) and is sized accordingly.

The top inch or so portion of the inclined plate 8 may be bent so as to be in the same plane as the top edges of the sidewall plates 11 (and of the bottom of the bucket 20) whereby means may be employed to prevent the trenching tool from sliding sideways along the bucket blade 21 during use. For example, a bolt may be inserted through a hole 9 in the top portion of the inclined plate 8 and through a hole in the bucket 20 or two small knobs 22 may be welded onto the bucket's leading edge with the top portion of the inclined plate 8 being deposed between them. Cutting edges 6 may be welded or otherwise attached to the forward edges 4 of the sidewall plates 1 and to the forward edge 14 of the inclined plate 2 to better cut through the dirt. If the cutting blade 21 of the bucket 20 is bolted to the bucket, two of the bolts themselves may serve as knobs with the top portion of the inclined plate 8 being deposed between them, the width of the top portion of the inclined plate 8 being appropriately sized to match the bolts' spacing.

The rearward half of each sidewall plate 1 may be tapered such that the bottom edge 10 approaches the straight top edge 11. Cross plates 3 may be attached to maintain the integrity of the assembly. Means 13 are provided for attaching the aft edge of the assembly 12 to the back part of the bucket. The top edges 11 of the sidewalls 1 have a length approximately equal to that of the bottom of the bucket. The width of the inclined plate 2 and consequently the spacing of the sidewall plates 1 determine the minimum width of the trench. The height of the sidewall plates 1 determines the maximum depth of the trench. For a foundation footing, the trench dimensions might typically be 8 inches deep and 16 inches wide. The inclined plate 2 serves to guide the dirt displaced during operation into the bucket. The slope of the inclined plate 2 with respect to the sidewall plates 1 may be approximately one inch of rise for every two to four inches of length.

The means 13 for attaching the rear edge 12 of the trenching tool to the bucket as shown in FIG. 1 is a hinged plate 14 and attached chain 15. The chain is fixed to the top edge of the bucket using a come-along winch. This arrangement is easily attached and detached from the bucket. Other similar means may be employed to securely fix the aft end of the trenching tool to the bucket. FIG. 2 shows the trenching tool attached to a front-end loader.

In operation, the front-end loader with the trenching tool attached to the bucket drives forward with the bottom of the bucket parallel to and just in contact with the soil surface (see FIG. 3). In good soil conditions, an accurately dimensioned trench is dug in a single pass with the displaced dirt sliding up the inclined plate 2 into the bucket. Any dirt displaced to the sides is also scooped up by the bucket riding along the surface. The dirt is subsequently deposited in a desired location without removing the trenching tool.

Since the trenching tool is pushed through the soil parallel to the surface, the maximum pushing force of the earthmoving equipment is employed. This force is further magnified since the trenching tool is much narrower than the full bucket blade. Ideally a single pass by the trenching tool will complete the trench. However, variations in soil types may require multiple passes along the trench at less than the maximum depth. The same trenching tool can make a wider trench by a second pass using part or all of the tool width.

What is claimed is:

1. A ditch trenching tool for attachment to the bucket of a front-end loader or skid-steer loader, the bucket having a linear blade and a bottom, comprising:

a pair of laterally opposing sidewall plates having top and bottom edges and forward and aft edges and having a length greater than the length of the bucket bottom and a height equal to the desired depth of the trench;

an inclined plate having two side edges, a leading bottom edge with corners, and a trailing top edge disposed between and attached to said sidewall plates to thereby maintain said sidewall plates in a generally vertically position, said leading bottom edge corners of said inclined plate being attached at the bottom forward edge of said sidewall plates and sloping upwards to a point several inches above the top edge of said sidewall plates thus forming a notch between the top edges of the sidewall plates and the inclined plate suitable for the insertion of the bucket blade and further several inches back from the trailing top edge of said inclined plate being bent parallel to a plane formed by the top edges of said sidewall plates;

means for attaching the aft edges of said sidewall plates to the bucket;

means for preventing the trenching tool from slipping sideways with respect to the bucket blade.

2. The trenching tool as set forth in claim 1, wherein cutting blades are attached to the forward edges of said sidewall plates and the leading bottom edge of said inclined plate.

3. The trenching tool as set forth in claim 1, wherein means for supporting said sidewall plates, in addition to said inclined plate, are employed to maintain said sidewall plates in a generally vertically position.

4. The trenching tool as set forth in claim 1, wherein the means for attaching the aft edges of said sidewall plates to the bucket is comprised of a hinged plate, a chain, and a come-along winch.

5. The trenching tool as set forth in claim 1, wherein the means for preventing the trenching tool from slipping with respect to the bucket blade is comprised of a bolt through a hole near the top trailing edge of said inclined plate and through a hole in the bucket bottom.

6. The trenching tool as set forth in claim 1, wherein the means for preventing the trenching tool from slipping with respect to the bucket blade is comprised of two knobs attached to the bucket blade with said bent parallel portion of said inclined plate being deposed between them.

7. The trenching tool as set forth in claim 1, wherein the slope of said inclined plate with respect to said sidewall plates is between 1:2 and 1:4, whereby said inclined plate rises between one inch for each two inches of its length and one inch for each four inches of its length.

* * * * *